United States Patent [19]

Powell

[11] 4,209,895

[45] Jul. 1, 1980

[54] METHOD OF MAKING A SOCKET CONTACT

[75] Inventor: Lloyd J. Powell, Newmarket, Canada

[73] Assignee: International Telephone and Telegraph Corporation, New York, N.Y.

[21] Appl. No.: 949,412

[22] Filed: Oct. 10, 1978

Related U.S. Application Data

[60] Division of Ser. No. 824,343, Aug. 15, 1977, Pat. No. 4,133,599, which is a continuation of Ser. No. 704,120, Jul. 12, 1976, abandoned.

[51] Int. Cl.[2] ..... H01R 43/00

[52] U.S. Cl. ..... 29/874; 29/423

[58] Field of Search ..... 29/630 D, 630 A, 751, 29/247, 753, 761, 453, 630 G, 521, 525, 451; 72/368, 369, 398, 410, 416, 405; 113/119; 339/256 R; 403/313, 284, 361

[56] References Cited

U.S. PATENT DOCUMENTS

| | | | |
|---|---|---|---|
| 2,554,813 | 5/1951 | Buchanan | 29/630 AX |
| 2,674,724 | 4/1954 | Just . | |
| 2,804,602 | 8/1957 | Vizcarrondo | 339/256 R X |
| 2,809,546 | 10/1957 | Broske | 29/630 X |
| 2,815,497 | 12/1957 | Redslob | 29/630 A X |
| 2,917,723 | 12/1959 | Gluck . | |
| 3,056,446 | 10/1962 | Schmidt et al. | 72/24 X |
| 3,243,868 | 4/1966 | Anderson et al. | 29/525 X |
| 3,389,371 | 6/1968 | Maynard . | |
| 3,406,376 | 10/1968 | Varrin . | |
| 3,564,487 | 2/1971 | Upstone et al. . | |

*Primary Examiner*—Francis S. Husar
*Assistant Examiner*—C. J. Arbes
*Attorney, Agent, or Firm*—Thomas L. Peterson

[57] ABSTRACT

A method of making a socket contact by forming a slotted cylinder and pressing it beyond its yield point to effect an oval like socket. In engagement with a pin, the socket wall provides a highly efficient spring action which is capable of producing high insertion and removal forces.

3 Claims, 16 Drawing Figures

FIG. 11
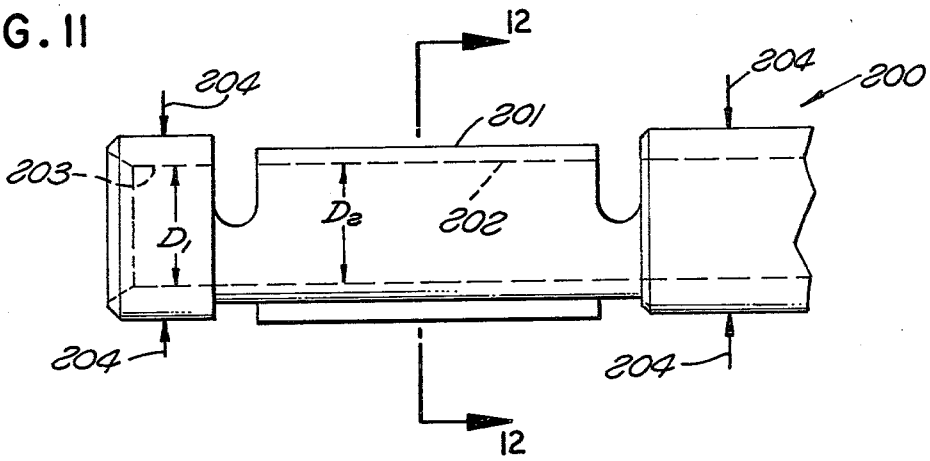
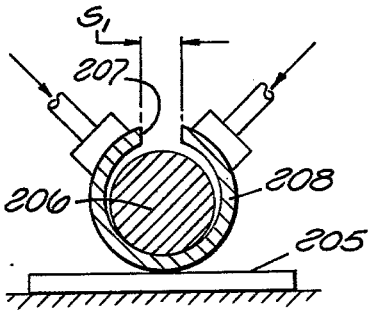
FIG. 12
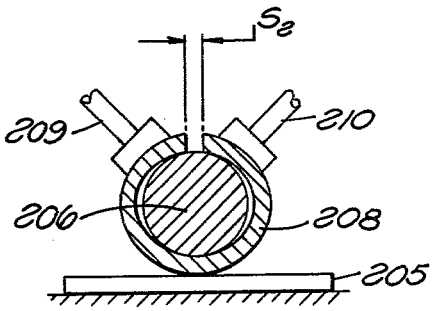
FIG. 13
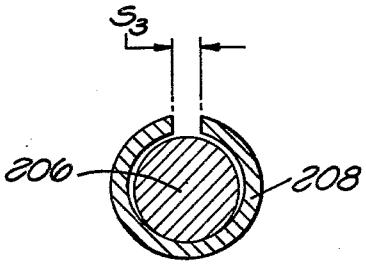
FIG. 14
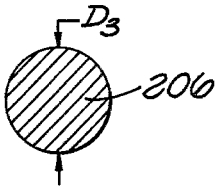
FIG. 15
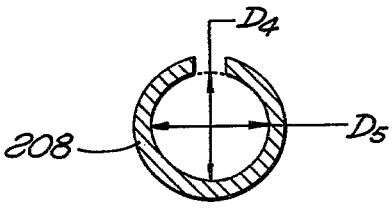
FIG. 16

METHOD OF MAKING A SOCKET CONTACT

CROSS-REFERENCE TO RELATED APPLICATIONS

This application is a division of a second copending application Ser. No. 824,343 filed Aug. 15, 1977 of the same title now U.S. Pat. No. 4,133,599, said second copending application, in twin, to be a continuation of a first copending application Ser. No. 704,120 filed July 12, 1976 of the same title, now abandoned. Said first and second applications being assigned to the same assignee as that of this application. The benefit of the filing dates of said first and second applications is therefore hereby claimed for this application.

BACKGROUND OF THE INVENTION

This invention relates generally to an electrical socket contact and, more particularly, to a spring socket contact capable of producing high insertion and removal forces.

A standard socket contact utilized in the connector industry comprises a tubular member which has a pair of opposed longitudinal slits therein opening at one end thereof, defining a pair of longitudinally extending spring fingers. The spring fingers function as spring beams which resiliently engage a pin contact inserted into the socket contact. Such a contact is disclosed in U.S. Pat. No. 3,564,487. U.S. Pat. No. 3,406,376 discloses a cylindrical socket contact having a single longitudinally extending slot opening at the forward end of the contact. In order to provide adequate spring action for the contact, a section of the wall of the contact is stamped inwardly and folded forwardly for resiliently engaging a pin contact inserted into the socket contact. There is also available in the connector industry a socket contact referred to as a "diaper" contact in which a split cylindrical spring sleeve is mounted on a socket contact body. When the pin contact is inserted into the socket contact, the spring sleeve expands so that a resilient spring engagement is produced between the pin and socket contacts. As will be readily appreciated by those skilled in the art, when the pin contact is inserted into a split cylindrical spring sleeve, the wall of the sleeve will deflect at the side of the sleeve opposite to the slot therethrough. Similar split sleeve contacts operating on the same principle as the diaper contact are disclosed in U.S. Pat. Nos. 2,674,724; 2,917,723; and 3,389,371.

While the foregoing socket contacts are generally suitable, for some applications they do not provide as high a spring engagement with the mating pin contacts as may be required, such as when the contacts are subjected to high vibrations and temperature fluctuations, as encountered in aircraft, for example. Therefore, the purpose of the present invention is to provide a reliable and efficient spring socket contact capable of producing high insertion and removal forces.

SUMMARY OF THE INVENTION

In accordance with the method of the present invention, the above described and other disadvantages of the prior art are overcome by making a socket contact utilizing the method step of forming a slotted cylinder and then deforming the slotted cylinder into an oval configuration or the like. The deformed cylinder then provides a highly efficient spring action which is capable of producing high insertion and removal forces.

BRIEF DESCRIPTION OF THE DRAWINGS

FIG. 11 is an enlarged broken away side elevation of a socket contact similar to that shown in FIG. 3;

FIG. 12 is a transverse sectional view of the socket contact taken on the line 12—12 shown in FIG. 11;

FIG. 13 is a view similar to that of FIG. 12 showing a fabrication step in accordance with the method of the present invention;

FIG. 14 is a view similar to that of FIG. 13 with a contact cylinder unstressed;

FIG. 15 is an end sectional view of a mandrel; and

FIG. 16 is a view similar to that of FIG. 14.

DESCRIPTION OF THE PREFERRED EMBODIMENTS

Figure 1:
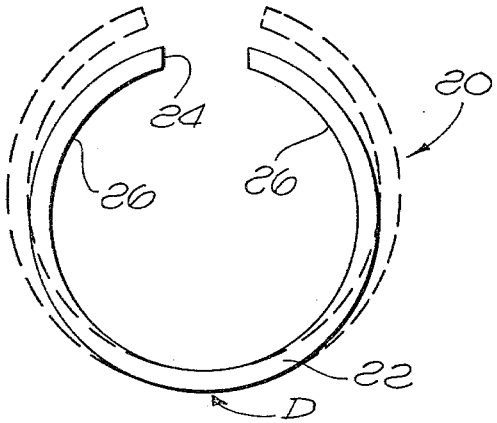
FIG. 1 PRIOR ART
FIG. 1 is a diagramatic illustration of the end of a split sleeve socket contact of the prior art type showing the wall of the contact in both its relaxed and expanded positions.

Reference is now made to FIG. 1 of the drawings, which illustrates an end view of a prior art type split sleeve socket contact 20. The contact comprises a tubular spring member 22 of conductive material having a longitudinally extending slot 24 extending the length thereof. The slot is defined by opposed arcuate sidewalls 26. When a pin contact, not shown, having a diameter greater than that of the tubular member 22, is inserted into the socket contact 20, the sidewalls 26 deflect about a single point D on the side of the member 22 opposite to the slot 24, moving to the positions shown in dotted lines in FIG. 1. Thus, the contact 20 is based on a "snap ring"-like principle.

Figure 2:
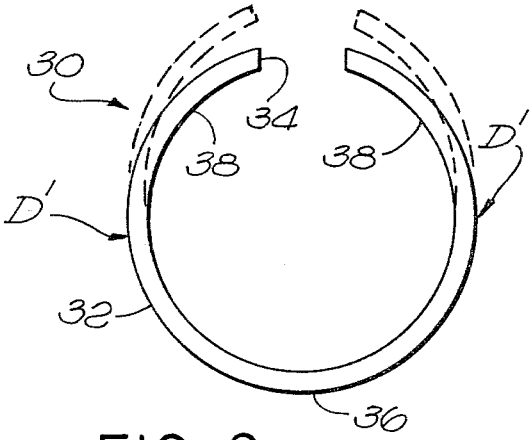
FIG. 2 is a diagramatic illustration similar to FIG. 1 showing the spring contacting section of the socket contact of the present invention in both its relaxed and expanded positions.

Reference is made to FIG. 2 which diagrammatically illustrates an end view of the spring contacting section 30 of the socket contact of the present invention. The contacting section comprises a tubular spring member 32 having a longitudinal slot 34 extending the length thereof. The side 36 of the tubular member 32 opposite to the slot 34 embodies means, to be described in detail later, which imparts sufficient stiffness to the arcuate sidewalls 38 of the tubular member so that when a pin contact is inserted into the socket contact, the sidewalls will deflect at two side regions D' between the slot and the opposite side 36, as shown in dotted lines in FIG. 2. Thus, in contrast to the prior art socket contact of FIG. 1 in which the sidewalls 26 deflect about a single point D, in section 30 (FIG. 2) of the socket contact of the present invention, the upper regions of the sidewalls 38 deflect about two points D'. The resiliently shiftable sidewalls 38 of the contact 30 operate on a beamloading principle which can be shown theoretically, and has been established by empirical data, to yield nominal insertion and removal forces approximately double that of the snap ring prior art socket contact, as illustrated in FIG. 1, assuming the same contact material, cross-section, etc., are used. The contact 30 also produces higher insertion and removal forces than the standard double spring finger socket contacts discussed hereinabove.

Figure 3:
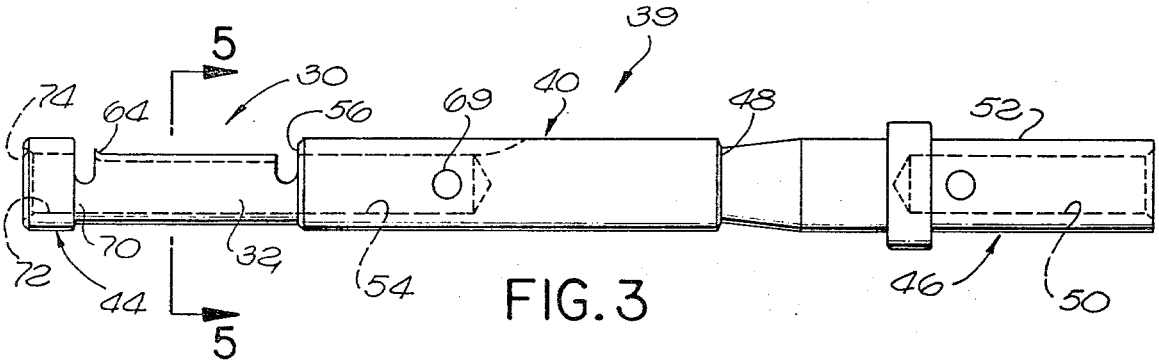
FIG. 3 is a side view of a socket contact in accordance with the present invention embodying a spring contacting section similar to that illustrated in FIG. 2.
Figure 4:
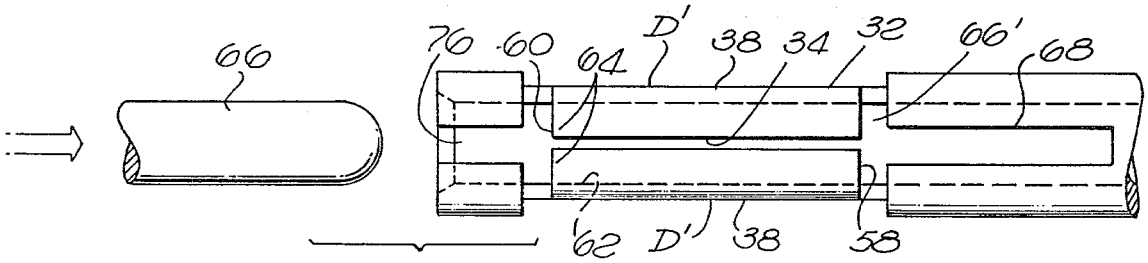
FIG. 4 is a fragmentary top view of the socket contact of FIG. 3 showing the front end thereof with a pin contact positioned to be inserted into the socket contact.
Figure 5:
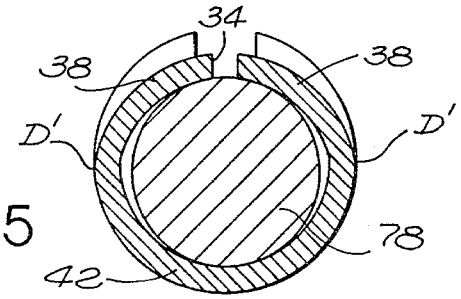
FIG. 5 is a transverse sectional view taken along line 5—5 of FIG. 3 showing the cross-sectional configuration of the spring contacting section of the contact in its relaxed condition, with an arbor pin therein which is used to form said contacting section.

Reference is now made to FIGS. 3 to 5 of the drawings which illustrate in detail the structure of a preferred form of the socket contact of the present invention, generally designated 39. Like reference numerals are utilized in FIGS. 3 to 5 to designate parts corresponding to those illustrated in FIG. 2. The socket contact 39 is fabricated from rod stock and comprises a spring contacting section 30, a rigid cylindrical body 40, a guide ring 44, and a wire termination section 46. The termination section 46 is coaxial with the cylindrical body 40 and is integrally joined to the rear 48 of the body. The termination section contains a rearwardly opening bore 50 which receives the wire (not shown) to be terminated to the contact. The wall 52 of the termination section 46 may be crimped onto the wire in a manner well known in the art.

A cylindrical passage 54 is formed in the body 40 and opens at the front 56 thereof. The spring contacting section 30 comprises a tubular spring member 32 of conductive material similar to that illustrated in FIG. 2. A longitudinally extending slot 34 extends from the rear 58 to the front 60 of the tubular member. The tubular member defines a bore 62 which is generally aligned with the passage 54 in the body 40. Preferably, the forward regions 64 of the sidewalls 38 adjacent to the slot 34 flare outwardly to facilitate insertion of a pin contact 66 into the contacting section 30 of the socket contact.

An arcuate connecting section 66' joins the rear 58 of the contacting section 30 to the front 56 of the rigid cylindrical body 40 of the socket contact. Preferably, the arcuate connecting section has a semicylindrical configuration. Due to the arcuate length of the connecting section and its connection to the rigid cylindrical body 40, the connecting section is relatively nondeformable and, therefore, imparts stiffness to the lower half of the tubular spring contacting section 30 of the contact. The connecting section 66' imparts sufficient stiffness to the contacting section so that the sidewalls 38 thereof deflect at the side regions D' when the pin contact 66, having a diameter greater than that of the bore 62, is forced into the contacting section as described previously herein with respect to FIG. 2.

It is seen that a longitudinally extending slot 68 is provided in the body 40 and opens at the front 56 thereof. The slot 68 is aligned with the slot 34. The slot 68 results from a saw-cutting operation which is required to longitudinally split the tubular spring contacting section 30 during manufacture. The material of the body 40 is sufficiently rigid so that the slot 68 does not impart any resilience to the body. Since the slot extends beyond the end of the bore 54, it may function as an inspection or drain hole. Alternatively, the slot 68 could be shortened or eliminated and an inspection hole 69 formed in the contact body. As illustrated, the contact embodies both the slot 68 and hole 69.

The guide ring 44 is joined to the front 60 of the contacting section 30 of the contact by means of a second arcuate connecting section 70, which may be identical to the connecting section 66'. The wall of the guide ring is preferably sufficiently thick so that the ring is rigid and, therefore, provides protection for the spring contacting section 30 and, together with the arcuate connecting section 70, also imparts stiffness to the lower region of the contacting section to assure that deflection of the sidewalls 38 takes place at the side regions D'. A circular bore 72 extends through the guide ring 44 coaxial with the passage 54 in the body 40. A lead-in chamber 74 is formed on the front end of the guide ring 44 to facilitate insertion of the pin contact 66 into the socket contact. The diameters of the bore 72 and passage 54 are slightly greater than the diameter of the pin contact 66 so that these passages may slidably receive the pin contact therein. The guide ring 44 has a longitudinally extending slot 76 therethrough which is aligned with the slot 68 in the body 40. Like a slot 68, slot 76 is formed by the saw cut used to form the slot through the contacting section 30 of the socket contact. The slot 76 serves no function and may be eliminated.

As seen in FIGS. 5 and 11–16, during the manufacture of the contact, the sidewalls 38 are collapsed upon an arbor pin 78 which has a diameter less than that of the pin contact 66. Thus, the tubular spring member 30 does not have an exactly circular cross-section, and the slot 34 therethrough is narrower than the slots 68 and 76.

While the guide ring 44 is desirable for protection of the spring contacting section 30 and for facilitating engagement of the pin contact with the socket contact, it may be eliminated assuming that the connecting section 66' imparts adequate stiffness to the contacting section 30.

Figure 6:
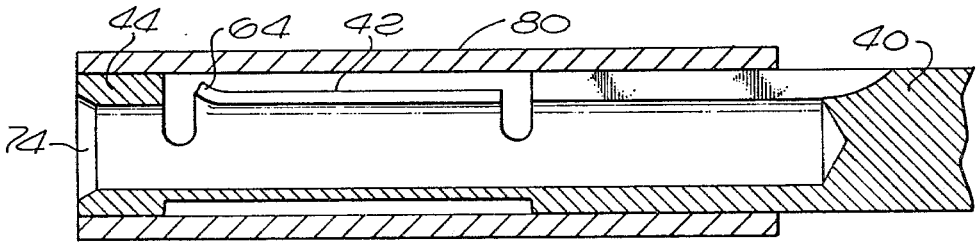
FIG. 6 is fragmentary, longitudinal section through a contact as illustrated in FIG. 3 with a protective hood mounted thereon.

In FIG. 6, a cylindrical hood 80 is shown that is frictionally fitted over the cylindrical body 40 and the guide ring 44. The hood provides protection for the socket contact against probe damage. Alternatively, the guide ring 44 could be a separate piece from the spring contacting section 30 of the contact and could be fixed to or integral with the protective hood 80. The guide ring-hood combination assures that the ring 44 is a closed, inflexible anchor point for imparting stiffness to the lower region of the contacting section 30.

Figure 7:
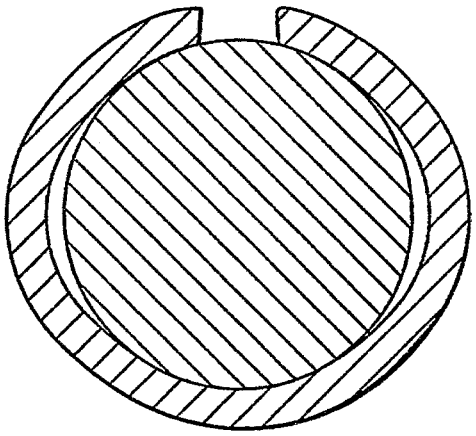
FIG. 7 is a cross-sectional view of the spring contacting section of a contact identical to that illustrated in FIGS. 3 to 5 with a pin contact mounted therein.
Figure 8:
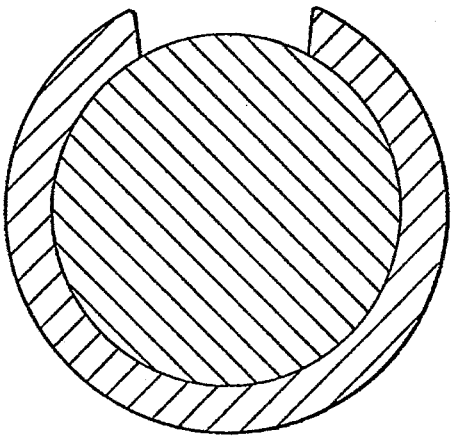
FIG. 8 (PRIOR ART)
FIG. 8 is a cross-sectional view similar to FIG. 7 illustrating a prior art type split sleeve contact as illustrated in FIG. 1 with a pin contact mounted therein.

Reference is now made to FIG. 7 of the drawing which illustrates a cross section of the spring contacting section of a socket contact identical to that illustrated in FIGS. 3 to 5, with a pin contact inserted therein. FIGS. 7 and 8 illustrate how the wall of the socket contact deflects at two regions along the sides of the contact, rather than at the side of the contact opposite to the slot therein. FIG. 8 illustrates a prior art type of snap ring contact such as described with reference to FIG. 1, formed of the same material as the contacting section of the socket contact illustrated in FIG. 7. A brief examination of the drawings will reveal the differences in deflections of the walls of the contacts. The contact of the present invention, illustrated in FIG. 7, has insertion and removal forces of approximately 5 lbs. while the like-dimensioned prior art contact illustrated in FIG. 8 has insertion and removal forces of about 2 lbs. Therefore, it is seen that the insertion and removal forces of the contact of the present invention are approximately double that of the prior art contact. As a consequence, the contact of the invention provides a more efficient and reliable spring engagement with a mating pin contact, and, therefore, is capable of withstanding greater vibrations and temperature differentials than the prior art contact.

Figure 9:
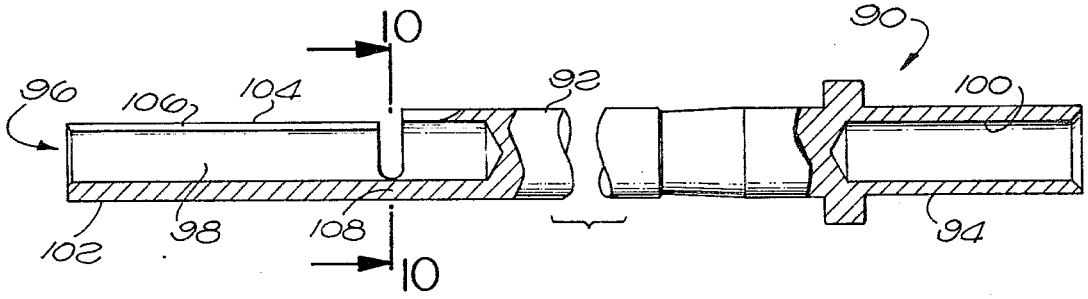
FIG. 9 is a longitudinal sectional view through an alternative form of the socket contact of the present invention.
Figure 10:
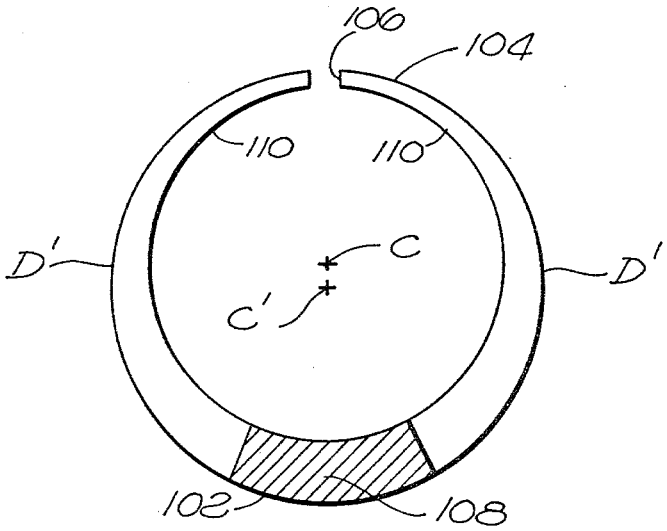
FIG. 10 is a transverse sectional view taken along line 10—10 on FIG. 9.

Reference is made to FIGS. 9 and 10 of the drawings which illustrate an alternative form of the contact of the present invention, generally designated 90. The contact 90 has a rigid cylindrical body 92 and a rear termination section 94 which may be identical to the body 40 and termination section 46 of the contact 39. The spring contacting section 96 extends forwardly from the body 92. The body 92 and spring contacting section 96 have a longitudinally extending bore 98 therein having a center axis C which is offset from the center axis C' of the bore 100 in the termination section 94 of the contact. As a consequence the thickness of the wall of the contacting section 96 is greater at the lower portion 102 than at the opposite upper section 104. A longitudinally extending slot 106 in the upper section 104 extends to the opposite ends of the contacting section 96. The contacting section 96 is joined to the body 92 of the socket contact by a connecting section 108 which may have an arcuate length substantially less than the connecting section 66' in the contact 39 due to the thickness of the lower region 102 of the tubular contacting section 96. Due to such lower thick region of the contacting section, sufficient stiffness is imparted thereto so that deflection of the sidewalls 110 of the contacting section of the socket contact takes place at points D', as seen in FIG. 10, between the bottom 102 and top 106 of the contact. Alternatively, the contact 90 could be provided with a connecting section 108 having a generally semi-cylindrical configuration, as the connecting section 66', to produce even higher insertion and removal forces.

Besides providing higher insertion and removal forces, and reliable and efficient spring engagements with the mating pin contacts, the socket contact of the present invention has a number of other advantages over prior art split sleeve socket contacts. The one-piece construction provided by the contact of the invention reduces manufacturing and assembly costs. Improved electrical efficiency results from reduced mechanical tolerances and commonality of materials. The contact is rugged and mating contact pressure variations due to differential thermal expansion and elevated temperatures are minimized. Since the central portion of the contact is a solid body, dust and moisture cannot pass therethrough which may affect the integrity of the electrical connection with the mating pin contact. Furthermore, since the body 40 has a uniform cross-section, it may be readily sealed in a suitable insulator which is not possible with socket contacts which are longitudinally split along their entire length. Furthermore, by simply varying the arcuate length of the connecting section 66', or the radial thickness of the connecting section 108, a wide range of insertion and removal forces is possible, for example 0.5 lb. to 17 lbs. for a size 16 contact.

A socket contact 200 is at first constructed as shown in FIG. 11. The structure shown in FIG. 11 may be identical to that shown in FIG. 3 except that bore diameter D, is equal to bore diameter $D_2$, and surfaces 201 and 202 are cylindrical and concentric with each other and with bore 203.

Completion of the fabrication of contact 200 is illustrated in FIGS. 12–16. In FIG. 11 contact 200 is held in a fixed position, for example, at arrows 204 on a fixed plate 205 in FIG. 12. A fixed cylindrical or elliptical mandrel 206 is inserted throughout the length of a cylinder 208 in FIG. 12. Cylinder 208 is unstressed in FIG. 12. In FIG. 12, if mandrel 206 is cylindrical and $D_2$ is initially greater than $D_3$ (FIG. 15) by a predetermined amount, cylinder 208 will eventually be as shown in FIG. 13. Cylinder 208 will have then been bent (by 209 and 210) past its elastic limit. When allowed to relax, cylinder 208 will be as shown in FIGS. 14 and 16.

In accordance with the foregoing, $S_1 > S_2$
$S_3 > S_2$
$S_1 > S_3$
$D_5 > D_4$
$D_5 > D_3$ If $D_6$ is the maximum diameter of pin 66 (FIG. 4), $D_6 > D_4$
$D_5 > D_6$ In accordance with the present invention, firstly a conductive cylinder 208 of a uniform inside diameter $D_2$ is formed with a slot 207 extending completely therethrough in a radial direction and over the complete length thereof and at one angular position thereround. Then cylinder 208 is permanently deformed in FIG. 13 by pressing 209 and 210 toward the side opposite the slotted side near where cylinder 208 is held on plate 205 and vice versa until portions of the cylinder 208 between the sides bend beyond their elastic limits to make the cylinder 208 out of round and somewhat elliptical, a first inside diameter $D_4$ of the unstressed, flattened cylinder 208 extending between the slotted and opposite sides being less than that of a second inside diameter $D_5$ perpendicular thereto.

Mandrel 206 may be described as a cylindrical rod having an outside diameter $D_3$ less than the undeformed inside diameter $D_2$ of the cylinder 208. Mandrel 206 is then placed inside cylinder 208 before it is deformed.

After bending beyond the elastic limit cylindrical pin contact 66 is mated to the cylinder 208, $D_6$ being larger than $D_4$ (FIG. 16), a first inside diameter, and smaller than a second inside diameter $D_5$.

I claim:

1. The method of making an electrical socket contact comprising the steps of:

forming a conductive cylinder of a uniform inside diameter with a slot extending completely therethrough in a radial direction and over the complete length thereof and at one angular position thereround;

providing a non-deformable cylindrical rod having an outside diameter less than the inside diameter of said cylinder;

placing said rod coaxially inside said cylinder;

permanently deforming said cylinder by pressing the slotted side thereof toward said rod until portions of said cylinder between said slotted side and the side opposite thereto bend beyond their elastic limits to make said cylinder somewhat elliptical, a first inside diameter of said deformed cylinder extending between said slotted and opposite sides being less than that of a second inside diameter thereof perpendicular thereto; and removing said rod from said deformed cylinder.

2. The method of making an electrical socket contact comprising steps of:

providing a segment of rod stock having a bore opening at an end thereof and a solid region spaced from said end;

cutting a longitudinal slot through the wall of said rod stock from said end to a point adjacent to said solid region;

forming a notch in said rod stock extending transverse to and through said slot at a position between said end and said solid region thereby forming in front of said notch a slotted cylindrical section and providing between said cylindrical section and said solid region an arcuate connecting section whereby the stiffness of said solid region is imparted through said connecting section to the side of said cylindrical section opposite to said slot;

permanently deforming said cylindrical section by pressing the slotted side thereof toward said opposite side and vice versa until portions of said cylindrical section between said sides bend beyond their elastic limits to form said cylindrical section into a somewhat elliptical section, a first inside diameter of said elliptical section extending between said slotted and opposite sides being less than that of a second inside diameter thereof perpendicular thereto.

3. The method as defined in claim 2, wherein:

a non-deformable cylindrical rod is provided having an outside diameter less than the inside diameter of said cylindrical section;

said rod being placed inside said cylindrical section before said cylindrical section is deformed;

said sides being collapsed onto said rod; and 111 said rod being removed from said deformed cylindrical section.

* * * * *